US008398266B2

(12) United States Patent
Wang

(10) Patent No.: US 8,398,266 B2
(45) Date of Patent: Mar. 19, 2013

(54) LAMINATED HEAT-DISSIPATING AND NON-DISPOSABLE LED LAMP

(75) Inventor: Robert Wang, Taoyuan County (TW)

(73) Assignee: Ceramate Technical Co., Ltd., Taoyuan County (TW)

( * ) Notice: Subject to any disclaimer, the term of this patent is extended or adjusted under 35 U.S.C. 154(b) by 104 days.

(21) Appl. No.: 13/208,407

(22) Filed: Aug. 12, 2011

(65) Prior Publication Data

US 2013/0039071 A1 Feb. 14, 2013

(51) Int. Cl.
*F21V 21/00* (2006.01)
*F21V 29/00* (2006.01)

(52) U.S. Cl. ..... 362/249.02; 362/294; 362/373; 362/650

(58) Field of Classification Search ..... 362/249.01, 362/249.02, 294, 373, 649, 650; 361/679.46–679.54, 361/688–723
See application file for complete search history.

(56) References Cited

U.S. PATENT DOCUMENTS 3,300,711 A * 1/1967 Duncan ..... 323/326
3,573,543 A * 4/1971 Grindstaff ..... 315/194
5,465,025 A * 11/1995 Hendrickson ..... 313/318.09
7,309,145 B2 * 12/2007 Nagata et al. ..... 362/294
7,708,452 B2 * 5/2010 Maxik et al. ..... 362/650
7,758,223 B2 * 7/2010 Osawa et al. ..... 362/547
7,832,909 B2 * 11/2010 Wang ..... 362/364
7,871,184 B2 * 1/2011 Peng ..... 362/294
8,222,820 B2 * 7/2012 Wang et al. ..... 315/32
8,272,762 B2 * 9/2012 Maxik et al. ..... 362/249.02
8,292,465 B2 * 10/2012 Horng et al. ..... 362/294
8,333,481 B2 * 12/2012 Deng ..... 362/20
8,348,471 B2 * 1/2013 Huang et al. ..... 362/294
2006/0232974 A1 * 10/2006 Lee et al. ..... 362/294

* cited by examiner

*Primary Examiner* — John A Ward
(74) *Attorney, Agent, or Firm* — Ming Chow; Sinorica, LLC

(57) ABSTRACT

A laminated heat-dissipating and non-disposable LED lamp includes a lamp holder, an LED luminous module, a lampshade and a heat dissipation unit. The lamp holder is provided with a hollow shell, the LED luminous module is assembled on the lamp holder and the lampshade is mounted on the LED luminous module. The heat dissipation unit is covered around the circumferential side of the lamp holder, instituted of a multi-ply heat-dissipating layer. By so designing, heat energy produced by the LED lamp can be transmitted to the heat dissipation unit, and the heat-dissipating layer can function to increase a heat dissipation area and a heat dissipation distance of contact of the LED lamp with open air, able to prolong service life and enhance luminous efficiency of the LED lamp and also reduce electronic waste.

9 Claims, 4 Drawing Sheets

LAMINATED HEAT-DISSIPATING AND NON-DISPOSABLE LED LAMP

BACKGROUND OF THE INVENTION

1. Field of the Invention

This invention relates to an LED lamp.

2. Description of the Prior Art

Generally, a fluorescent lamp has a comparatively short service life and poor brightness during lighting. To increase lighting brightness, a user usually needs to use a fluorescent lamp with comparatively high wattage or increase the number of fluorescent lamps, thus increasing consumption of electricity. In addition, the conventional fluorescent lamp contains mercury vapor and fluorescent powder that are harmful to human bodies; therefore, in recent years, LED lamps have gradually taken the place of general fluorescent lamps or power-saving bulbs. As commonly known, LEDs are able to economize energy and electricity and have high efficiency, quick reaction and a long service life, and also contain no mercury for conforming to environmental protection. In reality, service life and the reliability of any type of LED are mainly affected by temperature. Taking a high power LED for instance, after the LED receives electric energy, only 15-20% of the electric energy is converted into light, and nearly 80-85% of the electric energy is converted into heat energy. Therefore, a lamp using LED as a luminous source is apt to bring about excessively high temperature after being used for a long period of time and, if the heat energy produced by the shining LED cannot be conducted outward, the interface temperature of the LED will become excessively high to influence shining efficiency and stability and also affect service life. That is, the higher the temperature is, the shorter the service life will be. Substantially, only the LED module of a luminous source is likely to cause trouble; therefore, it is extremely essential to solve the problem how to elevate effect of heat dissipation for LED lamps to avoid accumulating heat energy and damaging the LED lamps.

Further, when the LED luminous module causes trouble and needs to be replaced, the power connecting components, which are still usable, are to be replaced together as well. In other words, the whole set of a LED lamp has to be thrown away and replaced with a new one, thus wasting money and contaminating the environment.

SUMMARY OF THE INVENTION

A first object of this invention is to offer a laminated heat-dissipating and non-disposable LED lamp, having excellent effect of heat dissipation, able to elevate service life and luminous efficiency of the LED lamp and also having effects of energy saving and carbon reduction for conforming to environmental protection.

A second objective of this invention is to offer a laminated heat-dissipating and non-disposable LED lamp, which has the components of a power connecting and the components of light emitting magnetically combined and together, easy to be detached and replaced separately, and able to greatly lessen electronic waste and attain effects of environmental protection and energy saving.

The laminated heat-dissipating and non-disposable LED lamp in the present invention includes a lamp holder, an LED luminous module, a lampshade and a heat dissipation unit. The lamp holder is formed with a hollow shell having an end provided with a threaded section and another end assembled with a fixing plate, which has one side opposite to the threaded section installed with an electric converter. The LED luminous module to be assembled on the lamp holder is disposed with a basic plate made of aluminum easy to conduct heat and inlaid thereon with a circuit board that has one side installed with numerous LEDs. The lampshade integrally made of transparent acrylic is set on the LED luminous module, while the heat dissipation unit also made of aluminum easy to conduct heat is axially formed with a multi-ply heat-dissipating layer shaped as a tube with plural plies of different diameters to be covered around the outer circumferential side of the lamp holder. There is a gap formed between every two adjacent plies of the heat dissipation layer, and each ply has one end connected with a corresponding end of an adjacent heat-dissipating layer and with the other end of one ply not connected with the corresponding other end of the adjacent ply. Further, the innermost ply of the heat-dissipating layer has its free end connected with the basic plate of the LED luminous module so that heat produced by the LEDs can be conducted to the heat dissipation unit through the basic plate, attaining effect of heat dissipation.

Thus, heat energy produced by the LED luminous module of the LED lamp can be transmitted to the heat dissipation unit, and the heat-dissipating layer can function to increase a heat dissipation area and a heat dissipation distance of the LED lamp contacting with open air, able to prolong service life and luminous efficiency of the LED lamp, lessening electronic waste and conform to environmental protection.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
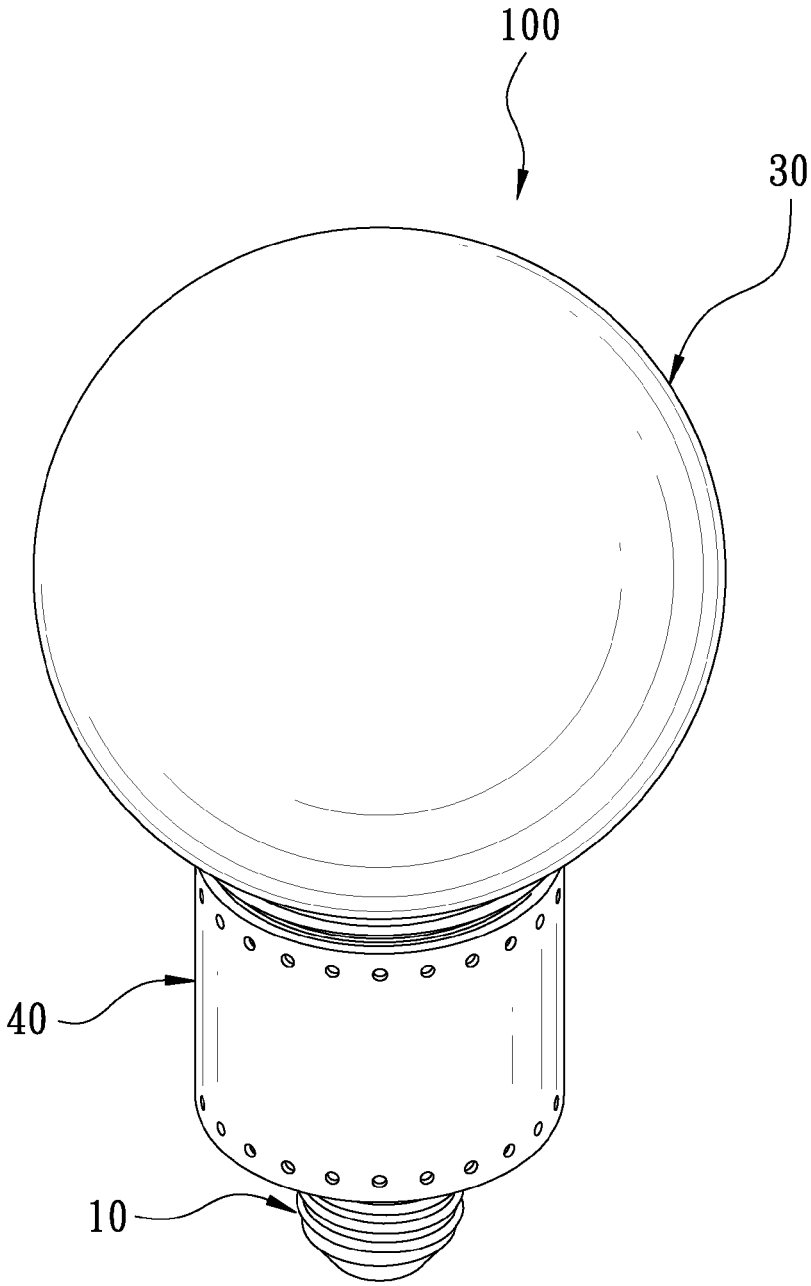
FIG. 1 is a perspective view of a first preferred embodiment of a laminated heat-dissipating and non-disposable LED lamp in the present invention.
Figure 2:
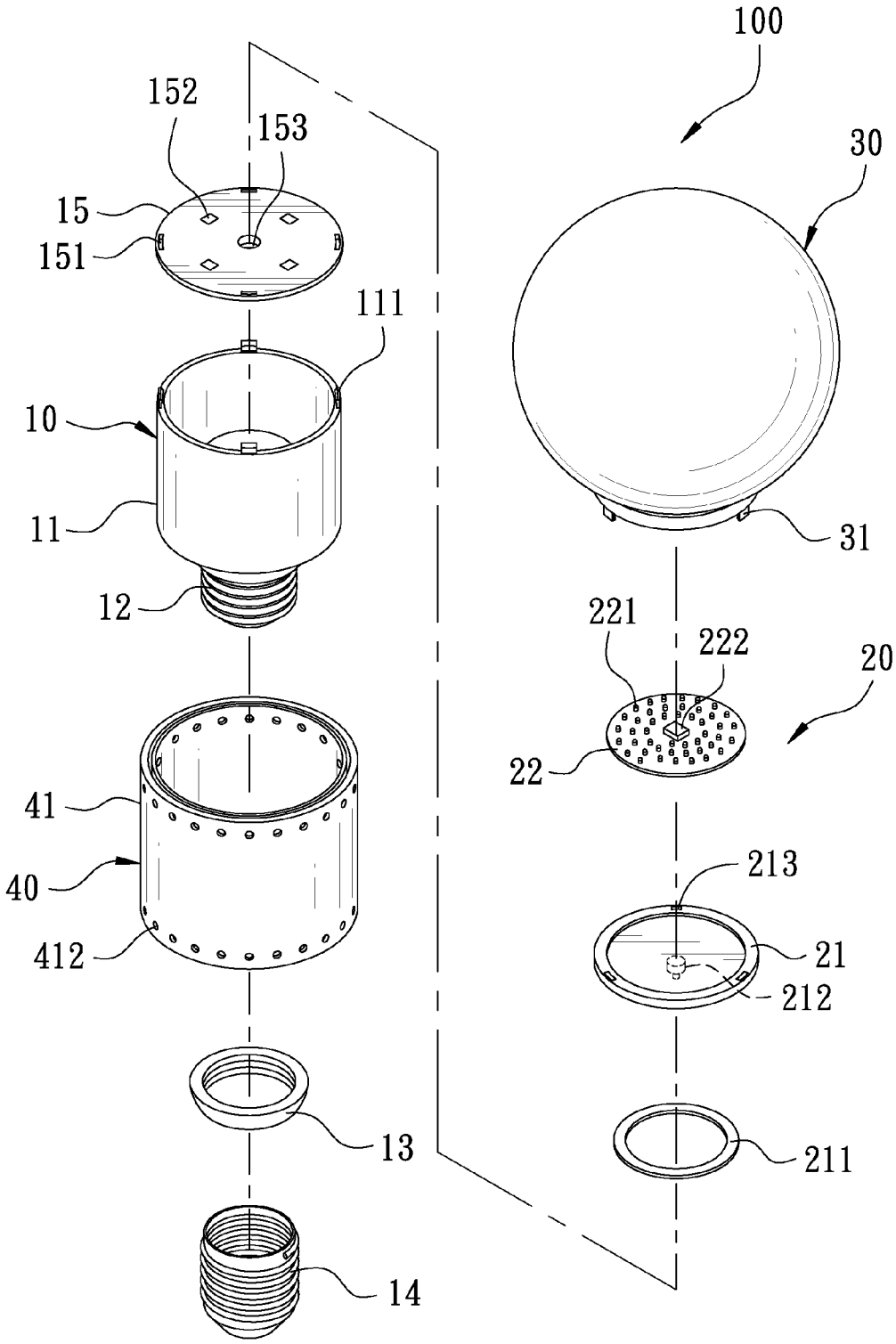
FIG. 2 is an exploded perspective view of the first preferred embodiment of the laminated heat-dissipating and non-disposable LED lamp in the present invention.
Figure 3:
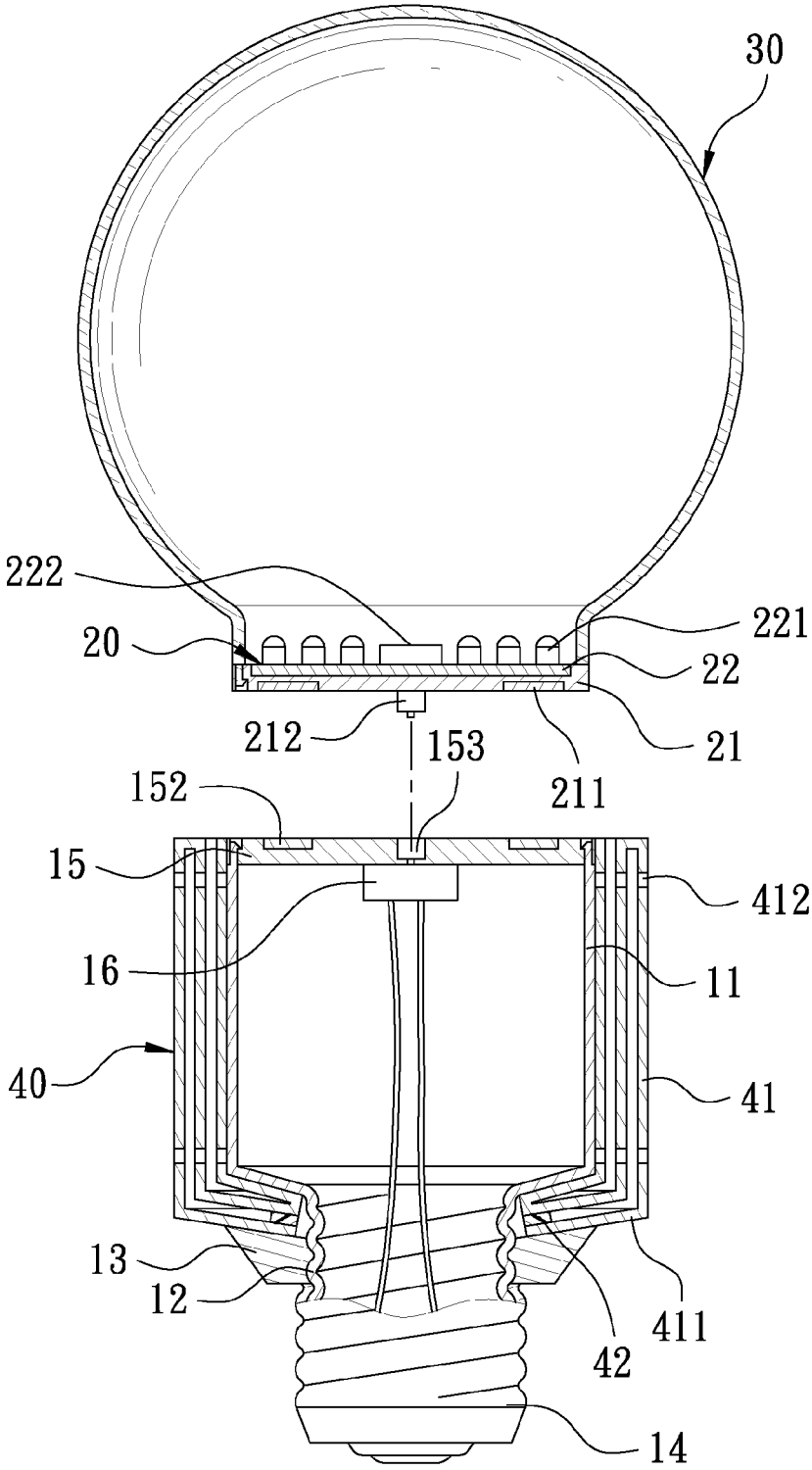
FIG. 3 is a cross-sectional view of the first preferred embodiment of the laminated heat-dissipating and non-disposable LED lamp in the present invention.

A first preferred embodiment of a laminated heat-dissipating and non-disposable LED lamp 100 in the present invention, as shown in FIGS. 1, 2 and 3, includes a lamp holder 10, an LED luminous module 20, a lampshade 30 and a heat dissipation unit 40 as main components combined together.

The lamp holder 10 made of plastic is formed with a hollow shell 11 having a lower end provided with a threaded section 12 with a comparatively small diameter, having a tightening ring 13 and an electric source connector 14 orderly and threadably fixed on the threaded section 12. The hollow shell 11 has its upper end assembled with an aluminum fixing plate 15 and its upper edge secured with four first tendons 111 protruding out axially and spaced apart equidistantly. The fixing plate 15 has its circumferential edge bored with four first mortises 151 to be correspondingly engaged with the first tendons 111 for securing the fixing plate 15 on the hollow shell 11. Further, the fixing plate 15 has one side opposite to the threaded section 12 set with a plurality of powerful magnets 152 and a first connecting portion 153. In this preferred embodiment, the four powerful magnets 152 are inlaid on the fixing plate 15 while the first connecting portion 153 is a co-axial annular metal seat having its interior provided with contacts to form a non-polar adapter. The fixing plate 15 has another side connected with a power converter 16 that is electrically connected with the first connecting portion 153 and a screw base 14 respectively. In this preferred embodiment, the power converter 16 can adopt a mode of capacitive voltage drop, a mode of transformer coupling, a mode of IC voltage drop supply or a mode of resistance direct voltage drop for converting alternating current into direct current. The screw base 14 is a metal threaded contact or also can be MR16 contact (not shown), whatever type of contact described in this invention.

The LED luminous module 20 disk-shaped is detachably assembled on the fixing plate 15, provided with an aluminum basic plate 21 and a circuit board 22 inlaid inwards at one side of the basic plate 21. The circuit board 22 has one side installed thereon with numerous LEDs 221 and a circuit driving unit 222, with the LEDs 221 spirally arranged on the circuit board 22. The basic plate 21 has another side fixed thereon with an annular iron sheet 211 and a second connecting portion 212 respectively corresponding with the powerful magnets 152 and the first connecting portion 153 of the fixing plate 15. In this preferred embodiment, the second connecting portion 212 is a co-axial annular metal terminal to be jointed and electrically connected with the first connecting portion 153, and further electrically connected with the circuit board 22. The LED luminous module 20 is fixed on the lamp holder 10 by mutual magnetic attraction of the iron ring 21 and the powerful magnets 152 of the lamp holder 10. Furthermore, apart from the way of magnetic attraction mentioned above, the LED luminous module 20 and the lamp holder 10 can also be combined together either in a way of screwing or a way of engagement. Moreover, the basic plate 21 of the LED luminous module 20 has its circumferential edge bored with three second mortises 213.

The lampshade 30 is a spherical shade integrally made of transparent acrylic and secured on the basic plate 21 of the LED luminous module 20, having the circumferential edge of an opening end axially disposed with three second tenons 31 to be correspondingly engaged in the second mortises 213 of the basic plate 21 and fixedly positioned on the LED luminous module 20.

The heat-dissipating unit 40 to be covered around the outer circumferential side of the lamp holder 10 is made of aluminum easy to dissipate heat, axially forming a three-ply heat-dissipating layer 41 respectively shaped as a tube with three plies of different diameters, and having a gap formed between every two adjacent plies. One end of each ply is connected with a corresponding end of an adjacent ply but with the other end of the ply not connected with the corresponding other end of the adjacent ply so that the heat dissipation unit 40 form a continuous S shape, and the ends of the heat-dissipating layer 41, which face the threaded section 12, is contracted inward to form a convergent section 411 and tightened by the tightening ring 13 to be superposed and fixed on the lamp holder 10. Thus, the laminated heat-dissipating layer 41 is covered around the outer circumferential side of the lamp holder 10. In addition, an isolating ring 42 is sandwiched between every two plies of a non-connected convergent section 411, and the innermost ply of the heat-dissipating layer 41 of the heat dissipation unit 40 has a free end combined and connected with the basic plate 21 of the LED luminous module 20 by means of heat-dissipating glue so that heat energy produced by the LEDs 221 can be conducted to the heat-dissipating unit 40 through the basic plate 21 for carrying out heat dissipation. Moreover, the heat-dissipating layer 41 of the heat dissipation unit 40 has an upper and a lower section annularly bored with a number of heat-dissipating holes 412.

Referring to FIG. 3, when the LED luminous module 20 of the LED lamp 100 starts emitting light, the LEDs 221 will have a part of electric energy converted into heat energy to make the temperature of the circuit board 22 grow high gradually. Since both the basic plate 21 and the heat-dissipating unit 40 are made of aluminum with good heat conductivity, the heat energy of the circuit board 22 will be first conducted to the basic plate 21 and then orderly transmitted to the fixing plate 15 and the heat-dissipating unit 40. In this way, the heat-dissipating route and the heat-dissipating area of contact of the LED lamp 100 with air will be increased effectively, and the heat energy produced by the LEDs 221 can quickly be conducted out to open air. Additionally, the heat dissipation unit 40 has its upper and lower section respectively bored with numerous heat-dissipating holes 412 to enable hot air in the interior of the LED lamp 100 to carry out convection with outside air to elevate heat dissipation efficiency of the LED lamp 100 and lower the temperature of the LED luminous module 20 for stabilizing lighting brightness of the LED luminous module 20, preventing the LED luminous module 20 from being damaged due to excessively high temperature, able to prolong the service life of the LED luminous module 20. Since the effect of heat dissipation of the LED lamp 100 has been enhanced, LEDs 221 with comparatively high wattage can be installed for use in accordance with a user's needs.

Since the LED luminous module 20 is combined with the fixing plate 15 of the lamp holder 10 by magnetic attraction, therefore, when the LED luminous module 20 has trouble and needs to be replaced, the LED luminous module 20 can easily be detached and replaced with a new one after the LED luminous module 20 is electrically disconnected from the utility power. What is worth mentioning is that when the LED lamp 100 is damaged, only the components of the lamp, such as the LED luminous module 20, which are apt to cause trouble, have to be replaced, needless to replace the power connecting parts that seldom causes faults. Therefore, it is unnecessary to throw away or replace a whole set of the lamp, but only to replace or repair the damaged components, able to save money, greatly reduce electronic waste and attain effects of environmental protection and energy saving.

Figure 4:
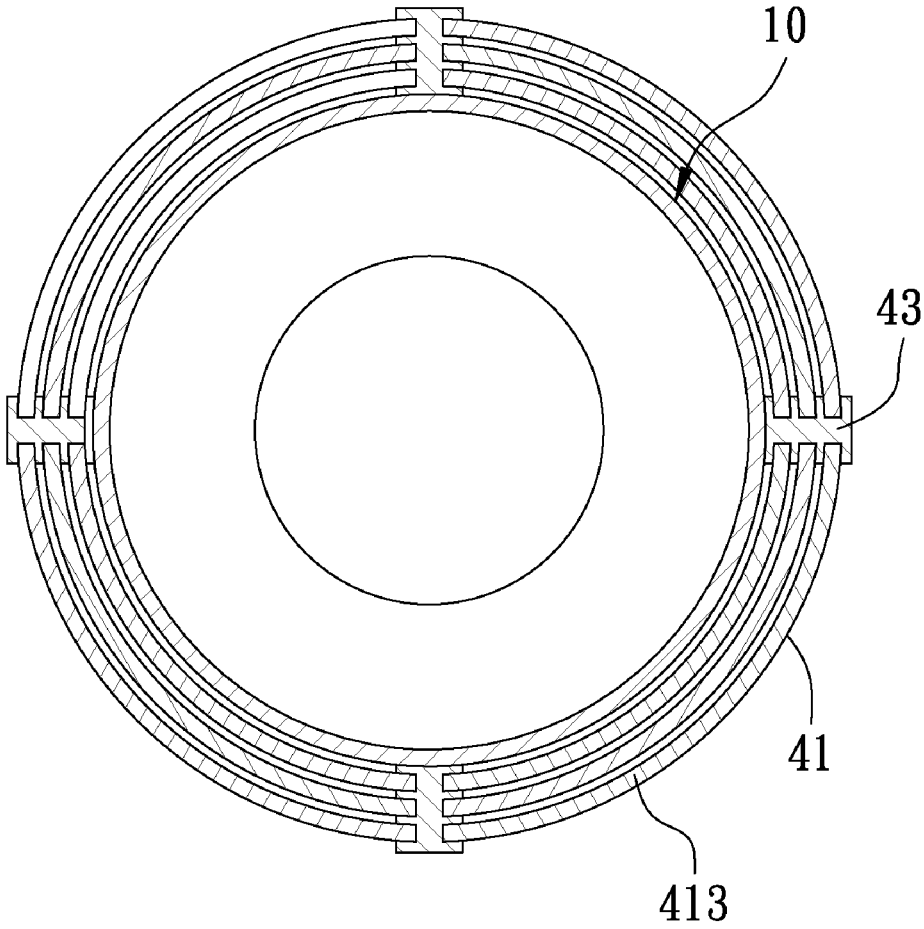
FIG. 4 is a cross-sectional view of a second preferred embodiment of a laminated heat-dissipating and non-disposable LED lamp in the present invention.

A second preferred embodiment of laminated heat-dissipating and non-disposable LED lamp in the present invention, as shown in FIG. 4, is almost the same in structure as that of the first preferred embodiment, except that the heat-dissipating layer 41 is formed by axially combining a plurality of circular bar blades 413 together, and plural positioning members 43 are fitted on the outer circumferential side of the lamp holder 10 for fixing the circular bar blades 413 of the heat dissipation unit 40 thereon. Thus, heat source produced by the LED luminous module 20 of the LED lamp 100 can be transmitted to the heat-dissipating layer 41, and the circular bar blades 413 can function to increase a heat-dissipating area and a heat-dissipating distance of contact of the LED lamp 10 with open air, able to achieve the same heat dissipation effect as that described in the first preferred embodiment.

The features and advantages of this invention are described as follows.

1. The heat-dissipating layer provided in the present invention is able to increase a heat-dissipating area and a heat-dissipating distance of contact of the LED lamp with open air, and the heat-dissipating holes of the heat dissipation unit can effectively dissipate heat. By so designing, the heat energy produced by the LED luminous module can quickly be conducted to open air to lower the temperature of the LED luminous module and stabilize the shining brightness of the LED luminous module and also prevent the LED luminous module from being damaged due to excessively high temperature for prolonging the service life of the LED luminous module.

2. In this invention, the components of the electric source and the components of the lamp are combined together by magnetic units so they can easily be detached and replaced. Therefore, when the LED lamp is damaged, what needs to be replaced or repaired is only the components of the lamp, which are easy to cause faults, but not the components of the electric power, which seldom have trouble, unnecessary to throw away or replace a whole set of the lamp, thus saving money, decreasing electronic waste, protecting the environment and economizing energy.

3. The heat-dissipating layers of the heat dissipation unit in the present invention can be increased in number according to variation of luminous power; therefore, electric bulbs with different powers can be manufactured and installed on same-sized lamp holders of this invention according to practical needs.

4. The LEDs of this invention are spirally arranged on the circuit board so that light source can be concentrated on a central region, and the number of the LEDs at outer perimeter can be increased or decreased so as to control shining brightness of the LED lamp, not affecting uniformity of light.

While the preferred embodiments of the invention have been described above, it will be recognized and understood that various modifications may be made therein and the appended claims are intended to cover all such modifications that may fall within the spirit and scope of the invention.

What is claimed is:

1. A laminated heat-dissipating and non-disposable LED lamp comprising:

a lamp holder being a hollow shell, said hollow shell having one end formed with a threaded section, said hollow shell having another end assembled thereon with a fixing plate, said fixing plate provided with a power converter at one side opposite to said threaded section;

an LED luminous module assembled on said lamp holder, said LED luminous module provided with a metal basic plate easy to conduct heat energy, said basic plate inlaid thereon with a circuit board, said circuit board having one side installed with numerous LEDs;

a lampshade integrally made of transparent acrylic, said lampshade assembled on said LED luminous module; and a heat dissipation unit covered around a circumferential side of said lamp holder, said heat dissipation unit made of aluminum that is easy to conduct heat energy, said heat dissipation unit axially formed into a multi-ply heat-dissipating layer that is shaped as a tube with plural plies of different diameter, said heat-dissipating layers covered around an outer circumferential side of said lamp hold, a gap formed between every two adjacent plies, each said ply having one end connected with a corresponding end of an adjacent ply and with the other end each ply not connected with the corresponding other end of the adjacent ply, an innermost ply of said heat-dissipating layer of said heat dissipation unit having a free end connected with said basic plate of said LED luminous module so that heat energy produced by said LEDs can be conducted to said heat dissipation unit through said basic plate for achieving effect of heat dissipation.

2. A laminated heat-dissipating and non-disposable LED lamp as claimed in claim 1, wherein said fixing plate provided with at least one powerful magnet and a first connecting portion at another side opposite to said threaded section, said first connecting portion electrically connected with said power converter, said basic plate of said LED luminous module provided with an iron ring and a second connecting portion to correspond with said powerful magnets and said first connecting portion of said fixing plate, said second connecting portion electrically connected with said circuit board, said first connecting portion and said second connecting portion jointed and electrically connected together, said LED luminous module magnetically secured on said lamp holder.

3. A laminated heat-dissipating and non-disposable LED lamp as claimed in claim 1, wherein said heat-dissipating layer is formed by a plurality of circular bar blades axially combined together, and said heat dissipation unit has plural positioning members fitted on an outer circumferential side of said lamp holder for fixing said circular bar blades with said positioning frames.

4. A laminated heat-dissipating and non-disposable LED lamp as claimed in claim 1, wherein a tightening ring and a screw base are orderly and threadably secured on said threaded section of said lamp holder, and said heat-dissipating layer of said heat dissipation unit has its end that faces said screw base contracted inward to form a convergent section, said convergent section of said heat-dissipating layer tightened by said tightening ring and superposed and fixed on said lamp holder, then said screw base screwed on said threaded section.

5. A laminated heat-dissipating and non-disposable LED lamp as claimed in claim 1, wherein an isolating ring is sandwiched between every two adjacent heat-dissipating plies at non-connected said convergent section.

6. A laminated heat-dissipating and non-disposable LED lamp as claimed in claim 1, wherein said heat-dissipating layer of said heat dissipation unit is annularly bored with a number of heat-dissipating holes at two ends.

7. A laminated heat-dissipating and non-disposable LED lamp as claimed in claim 1, wherein said LEDs are spirally arranged on said circuit board.

8. A laminated heat-dissipating and non-disposable LED lamp as claimed in claim 1, wherein said hollow shell of said lamp holder has an end edge opposite to said threaded section axially mounted with a plurality of first tenons, and said fixing plate has a circumferential edge bored with a plurality of first mortises corresponding with said first tenons to enable said fixing plate to be assembled on said hollow shell of said lamp holder by means of engagement of said first tenons and said first mortises.

9. A laminated heat-dissipating and non-disposable LED lamp as claimed in claim 1, wherein said lampshade is disposed with a plurality of second tenons at a circumferential edge of an opening end, while said basic plate has a circumferential edge bored with a plurality of second mortises corresponding with said second tenons to enable said lampshade to be assembled on said basic plate of said LED luminous module by means of said second tenons and said second mortises.

* * * * *